US010987568B2

(12) United States Patent
Funaki

(10) Patent No.: US 10,987,568 B2
(45) Date of Patent: Apr. 27, 2021

(54) AUTO SCORER FOR DISPLAYING ROLLS DECIDING OUTCOME

(71) Applicant: Hiroshi Funaki, Akita (JP)

(72) Inventor: Hiroshi Funaki, Akita (JP)

( * ) Notice: Subject to any disclaimer, the term of this patent is extended or adjusted under 35 U.S.C. 154(b) by 130 days.

(21) Appl. No.: 16/095,139

(22) PCT Filed: Jun. 8, 2016

(86) PCT No.: PCT/JP2016/066982
§ 371 (c)(1),
(2) Date: Oct. 19, 2018

(87) PCT Pub. No.: WO2017/212558
PCT Pub. Date: Dec. 14, 2017

(65) Prior Publication Data

US 2020/0171373 A1 Jun. 4, 2020

(51) Int. Cl.
*A63D 5/04* (2006.01)

(52) U.S. Cl.
CPC ..... *A63D 5/04* (2013.01); *A63D 2005/048* (2013.01)

(58) Field of Classification Search
CPC ..... A63D 2005/048; A63D 5/04
USPC ..... 473/54, 70
See application file for complete search history.

(56) References Cited

U.S. PATENT DOCUMENTS

| | | | | |
|---|---|---|---|---|
| 5,842,929 | A | 12/1998 | Moody et al. | |
| 2001/0024977 | A1* | 9/2001 | Funaki | A63D 5/04 473/54 |
| 2009/0143883 | A1* | 6/2009 | Pines | A63D 5/04 700/92 |
| 2013/0324272 | A1* | 12/2013 | Vaioli | A63D 5/04 473/70 |

FOREIGN PATENT DOCUMENTS

| | | | |
|---|---|---|---|
| JP | S61-16759 | A | 1/1986 |
| JP | 3023958 | U | 5/1996 |
| JP | 2000-512871 | A | 10/2000 |
| JP | 2001-259109 | A | 9/2001 |
| JP | 2008-119070 | A | 5/2008 |
| JP | 2010-190487 | A | 9/2010 |
| WO | 2015/177844 | A1 | 11/2015 |

OTHER PUBLICATIONS

International Search Report issued in International Bureau of WIPO Patent Application No. PCT/JP2016/066982, dated Aug. 30, 2016.

* cited by examiner

*Primary Examiner* — Benjamin Layno

(74) *Attorney, Agent, or Firm* — Greenblum & Bernstein, P.L.C.

(57) ABSTRACT

When a bowler begins a roll and the result of the roll is detected by a scanner, the detection result is transmitted as data to a host computer via a bowler console assigned to each lane, and the scores of the bowlers are tallied. The scores of the bowlers are transmitted to a sub computer connected to or housed within the host computer, possible maximum scores are calculated by adding to the scores of the roll results the scores that would be attained by knocking down all pins with no misses in subsequent rolls, and the rolls needed to decide the rankings, point differences, and outcome are determined. The rolls needed to decide the calculated rankings, point differences, and outcome are displayed on a lane monitor, a ranking table monitor, a televised lane screen, a televised player, and a televised ranking table screen.

8 Claims, 11 Drawing Sheets

| Ranking | Player | Game | Frame | Game Score | Total | Maximum | Difference | Final Round Advancement Score |
|---|---|---|---|---|---|---|---|---|
| 1 | DOMINIC BARRETT | 1/6 | 9 | 108 | 108 | 1738 | - | - |
| 2 | JASON BELMONTE | 1/6 | 9 | 175 | 175 | 1735 | -3 | - |
| 3 | MIKE FAGAN | 1/6 | 9 | 173 | 173 | 1733 | -5 | - |
| 4 | MIKA KOIVUNIEMI | 1/6 | 10 | 214 | 214 | 1732 | -6 | - |
| 5 | MARTIN LARSEN | 1/6 | 10 | 201 | 201 | 1721 | -17 | - |
| 6 | OSKU PALERMAA | 1/6 | 10 | 199 | 199 | 1710 | -10 | - |
| 7 | SEAN RASH | 2/6 | 1 | 10 | 207 | 1697 | -41 | -22 |
| 8 | TOMMY JONES | 2/6 | 1 | 9 | 211 | 1690 | -48 | -29 |
| | BILL O'NEIL | 2/6 | 1 | 9 | 211 | 1690 | -48 | -29 |
| 10 | STUART WILLIAMS | 2/6 | 1 | 10 | 178 | 1675 | -60 | -41 |

FIG. 5

Preliminary

Brunswick Open

| Ranking | Player | Game | Frame | Game Score | Total | Maximum | Difference | Final Round Advancement Score |
|---|---|---|---|---|---|---|---|---|
| 1 | DOMINIC BARRETT | 1/6 | 9 | 198 | 198 | 1738 | - | - |
| 2 | JASON BELMONTE | 1/6 | 9 | 175 | 175 | 1735 | -3 | - |
| 3 | MIKE FAGAN | 1/6 | 9 | 173 | 173 | 1733 | -5 | - |
| 4 | MIKA KOIVUNIEMI | 1/6 | 10 | 214 | 214 | 1732 | -6 | - |
| 5 | MARTIN LARSEN | 1/6 | 10 | 201 | 201 | 1721 | -17 | - |
| 6 | OSKU PALERMAA | 1/6 | 10 | 199 | 199 | 1719 | -19 | - |
| 7 | SEAN RASH | 2/6 | 1 | 10 | 207 | 1697 | -41 | -22 |
| 8 | TOMMY JONES | 2/6 | 1 | 9 | 211 | 1690 | -48 | -29 |
| | BILL O'NEIL | 2/6 | 1 | 9 | 211 | 1690 | -48 | -29 |
| 10 | STUART WILLIAMS | 2/6 | 1 | 10 | 178 | 1678 | -60 | -41 |

AUTO SCORER FOR DISPLAYING ROLLS DECIDING OUTCOME

TECHNICAL FIELD

The present disclosure relates to an auto scorer capable of displaying middle rankings and rolls required deciding winning or losing (hereinafter, referred to as "an outcome") in real time, and increasing a degree to which players, spectators, and viewers of a television or Internet live moving picture may understand a game situation in a bowling competition in a bowling alley.

BACKGROUND ART

Conventionally, when performing a bowling game in a bowling alley using an auto scorer which automatically calculates scores, bowler names and handicaps for each lane are manually input in an MCT computer installed at a front from an MCT keyboard before starting a competition.

Then, after starting the game, the number of knocked down pins for each roll is detected by scanners installed at each lane, and by data communication of a host computer connected to bowler consoles assigned to each lane, roll results and total scores for each roll of each bowler are displayed on a monitor screen. After the competition ends, scores of each bowler and rankings of comparing the scores are printed and displayed thereon.

In addition, according to bowling game systems that can display total rankings by automatically storing and compiling scores for each frame of players who are playing a game at separate lanes, it is known that not only simple current scores, but also predicted scores predicting final scores on the basis of the current scores, a highest reachable score that can be scored by continuously getting strikes in the future, and scores predicted based on personal information of the bowlers are displayed (see Patent Document 1).

These systems have the following disadvantages.

(A) When holding a competition using the conventional auto scorer, there has been no means for calculating how many points of scores required deciding the rankings and outcome in the future are attained by the player in the middle of the game, such that there has been no means for determining and displaying at what point the rankings and outcome are decided and were decided.

(B) Therefore, in a competition in which the number of participants is larger, players in the competition and spectators who are watching the games did not know at what point the rankings and outcome will be decided, and did not know the moment that the outcome which is an essence of sports is decided. In addition, since the calculation of the scores of bowling is complicated, in a final tournament with a small number of players, there has been many cases in which the player himself/herself or a commentator of a live television broadcast has made a mistake in calculating the scores by mental arithmetic, and in determining at what point the outcome will be decided if a certain number of pins are knocked down.

(C) In addition, in a competition in which the number of participants is larger, the rankings have been printed and displayed on a ranking sheet for the first time after the games of all participants end, such that there has been no means for displaying the rankings in the middle of the game. That is, it could not determine and display the rankings until the games of all participants end.

(D) Therefore, in a competition in which the number of participants is larger or a preliminary of the competition, the players and spectators who are watching the game do not know the middle rankings, such that they did not know who is the dominant player, resulting in bowling being not such an exciting sport.

(E) In a screen displayed on a monitor above the lane, player names and scores are displayed with being fixed in a rolling order on the rolling lane of the first ball, although the ranking is not displayed. Further, when competing in an American method of using two lanes and alternately rolling at left and right lanes in odd frames and even frames, the rolling lanes are indicated by arrows.

(F) Therefore, there have been cases in which the rankings of the players could not be known, as well as unfamiliar players have mistaken the left and right rolling lanes.

(G) When broadcasting the games live on a television, there has been no means for displaying middle rankings and roll results (strikes, spares, or how many pins) required deciding the outcome in images for each lane and respective players during the game on the screen in real time.

(H) Therefore, although it has been required to manually input the scores for the television screen, in the live broadcast, there is no time for manually inputting the roll results (strikes, spares, or how many pins) required deciding the outcome. Therefore, the commentator has had to orally describe the rolls required deciding the outcome by calculating the scores by mental arithmetic.

CITATION LIST

Patent Document

[Patent Document 1] Japanese Unexamined Patent Application Publication No. 2008-119070

SUMMARY OF INVENTION

Technical Problem

It is an object of the present disclosure to provide an auto scorer for displaying rolls deciding an outcome, which includes: a means configured to display rankings and score differences for each player or team based on maximum possible scores thereof during a game when performing a bowling game in a bowling alley; a means configured to display a final rank or roll results (strikes, spares, or how many pins) required deciding an outcome on screens; and a means configured to display the same in images for each lane and images of each player, and on a screen of a ranking table.

Solution to Problem

In order to achieve the above-described object, according to the present disclosure, there is provided an auto scorer for displaying rolls deciding an outcome including: a means configured to calculate maximum possible scores by adding scores that would be attained by knocking down all pins with no miss in subsequent rolls to the scores of roll results for each player or team during a game when performing a bowling game in a bowling alley, compare the calculated maximum possible scores with those of other players, and display score differences therebetween; a means configured to display final rankings or roll results (strikes, spares, or how many pins) required deciding an outcome on a screen; and a means configured to display rankings in the middle of the game in a ranking list.

In addition, the auto scorer includes: a means configured to display players for each lane together with rankings in an order from a player of a top ranking based on maximum possible scores during a game; a means configured to alternately move score displays of bowlers on monitor screens above lanes of the bowlers at every roll, when competing in an American method of using two lanes and alternately rolling at left and right lanes in odd frames and even frames; and a means configured to display of middle rankings based on the maximum possible scores, and final rankings or roll results (strikes, spares, or how many pins) required deciding an outcome on screens for respective players during the game.

Advantageous Effects

The auto scorer of the present disclosure includes: a means configured to calculate maximum possible scores of players during a game, compare the calculated maximum possible scores with those of other players, and display score differences therebetween; and a means configured to display final rankings or roll results (strikes, spares, or how many pins) required deciding an outcome on a screen. Therefore, it is possible to determine at what point and how the player or team rankings and the outcome during the game are decided.

The auto scorer of the present disclosure includes: a means configured to calculate maximum possible scores of players during a game, and display the calculated maximum possible scores in a ranking list together with score differences between the players and rankings in the middle of the game; and a means configured to display final rankings or roll results (strikes, spares, or how many pins) required deciding an outcome on a screen. Therefore, it is possible to display the rankings of all participants in the middle of the game.

The automatic scorer of the present disclosure includes: a means configured to calculate maximum possible scores for each player during a game, and display players of a top ranking for each lane together with rankings in an order from a top based on the calculated maximum possible scores during the game; and a means configured to alternately move displays of bowlers on monitor screens above lanes of the bowlers at every roll, when competing in an American method of using two lanes and alternately rolling at left and right lanes in odd frames and even frames. Therefore, the names and scores of the players are displayed in a rolling order during the game, and when competing in the American method, the players are displayed above the rolling lane, such that it is possible to solve a case in which the player mistakes the left and right rolling lanes.

The auto scorer of the present disclosure includes: a means configured to perform a TELOP display of middle rankings based on maximum possible scores, and final rankings or roll results (strikes, spares, or how many pins) required deciding an outcome on screens for respective players during a game. Therefore, it is possible to display the middle rankings, the score difference with other players, and the rolls required deciding the outcome in images for each lane and images for the player on the screens in real time. In the live broadcast of the television, conventionally, the commentator had to orally explain the rolls required deciding the outcome by calculating the scores by mental arithmetic, but the present disclosure may solve such a problem.

BRIEF DESCRIPTION OF DRAWINGS

FIG. 5 is a display diagram of a ranking table monitor 10 and a televising ranking table screen 13 illustrating a specific display example in the preliminary of the competition when using the present disclosure.

DESCRIPTION OF EMBODIMENTS

Hereinafter, an embodiment of an auto scorer for displaying rolls deciding an outcome of the present disclosure will be described with reference to the accompanying drawings.

Figure 1:
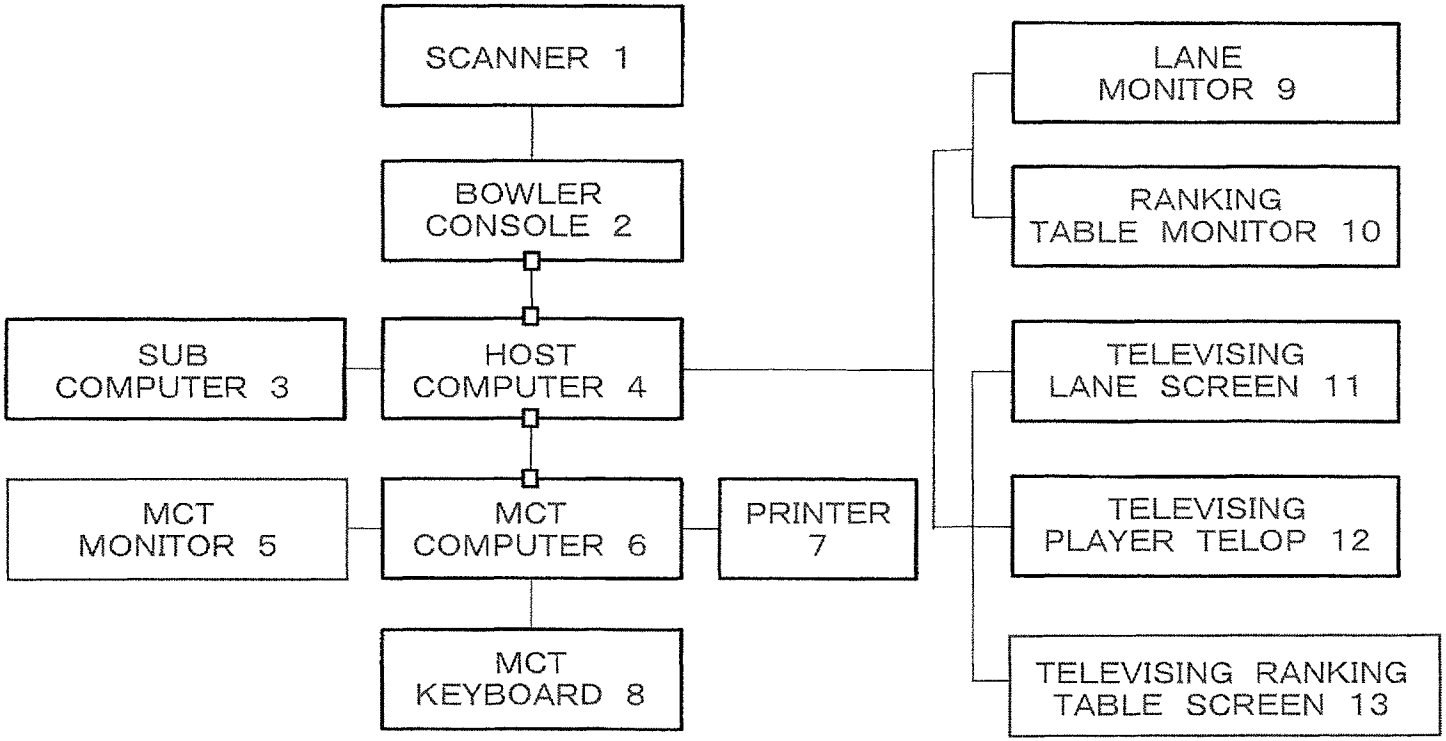
FIG. 1 is a display diagram of a data communication network configuration according to an embodiment of the present disclosure.

As illustrated in FIG. 1, the auto scorer for displaying rolls deciding an outcome of the present disclosure includes: scanners 1 for detecting roll results; bowler consoles 2 assigned to each lane for controlling operations of the scanners 1; a host computer 4 which is connected to the bowler consoles 2 to control operations thereof; a sub computer 3 which is connected to the host computer 4 to calculate middle rankings based on maximum possible scores on the basis of roll results, store score data by a combination of the number of knocked down pins and the number of spares and strikes, and transmit roll information that will decide an outcome; lane monitors 9 which are connected to the host computer 4 to display bowler names, roll results, middle rankings, and rolls deciding the outcome; a ranking table monitor 10; a televising lane screen 11; a televising player TELOP 12; a televising ranking table screen 13; an MCT computer 6 which is connected to the host computer 4 to control an operation thereof; an MCT monitor 5 for displaying information from the MCT computer 6; a printer 7 for printing the information from the MCT computer 6; and an MCT keyboard 8 for manually inputting the information into the MCT computer 6.

Next, an operation of the auto scorer for displaying rolls deciding an outcome of the present disclosure will be described below based on the accompanying drawings.

By using the MCT keyboard 8 connected to the MCT computer 6 illustrated in FIG. 1, the player names and handicap are manually inputted by an operator for each team in a case of a team match.

When the handicap is inputted, all the calculation of scores during a game, calculation of rankings and an outcome are calculated as handicap-included scores.

Final round advancement line in a case of a preliminary of a competition is decided by rankings of 2 to 100 people or less by manual inputting for each competition.

When bowlers start a roll and roll results are detected by the scanners 1, detection result data are transmitted to the host computer 4 via the bowler consoles 2 assigned to each lane, and scores of each bowler are calculated.

The scores of each bowler are transmitted to the sub computer 3 connected to or built in the host computer 4. Then, the sub computer calculates maximum possible scores by adding the score that would be attained by knocking down all pins with no miss in subsequent rolls to the scores of the roll results, and determines rankings, score differences, and the rolls required to decide the outcome.

In addition, the sub computer 3 has a means for connecting to the televising lane screen 11 and the televising player TELOP 12 without passing through the host computer 4. In this case, the scores of each bowler are manually inputted for each roll, and the maximum possible scores are calculated, and the rankings, score differences, and rolls required deciding the outcome are determined.

The calculated rankings, score differences, and rolls required deciding the outcome are displayed on the lane monitor 9, the ranking table monitor 10, the televising lane screen 11, the televising player TELOP 12, and the televising ranking table screen 13, which will be described below.

Figure 4:
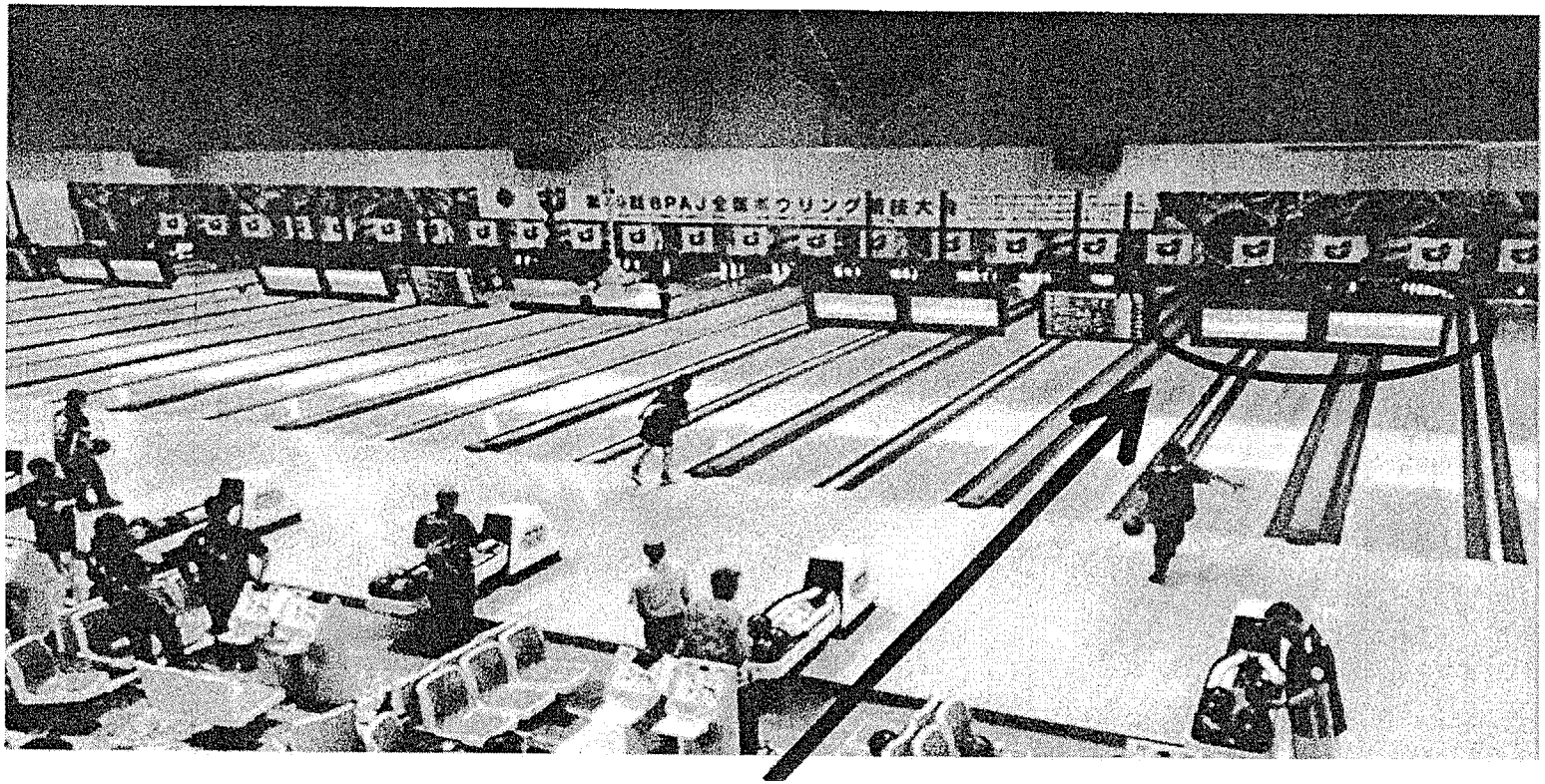
FIG. 4 is a display diagram illustrating a specific example of posting the lane monitor 9 when using the present disclosure.

The bowler names and roll information displayed on the lane monitor 9 and the televising lane screen 11 illustrated in FIG. 4 are alternately displayed by moving on the left and right sides of the two lanes when competing in an American method. However, when configuring in such a way that pro bowlers move in a box in a pro challenge, the bowler names and roll information are displayed by moving the box every arbitrary number of frames.

Figure 2:
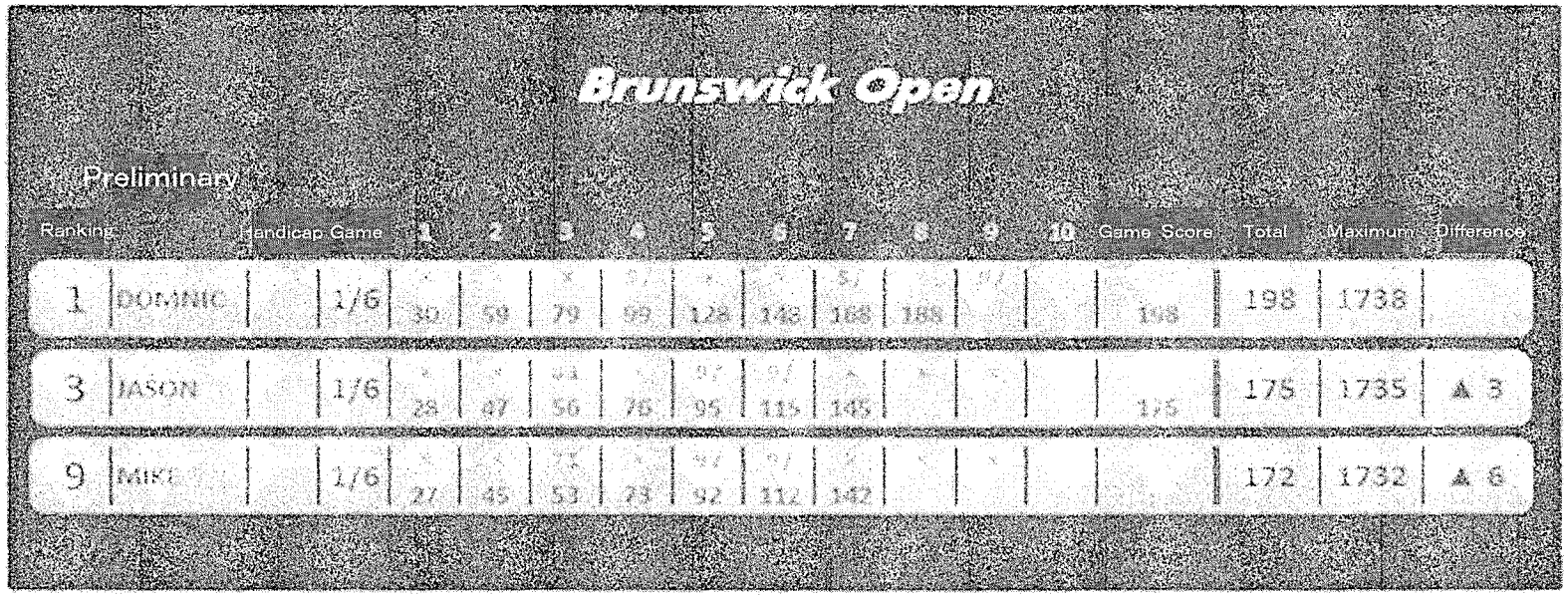
FIG. 2 is a display diagram of a lane monitor 9 and a televising lane screen 11 illustrating a specific display example in a preliminary of a competition when using the present disclosure.
Figure 3:
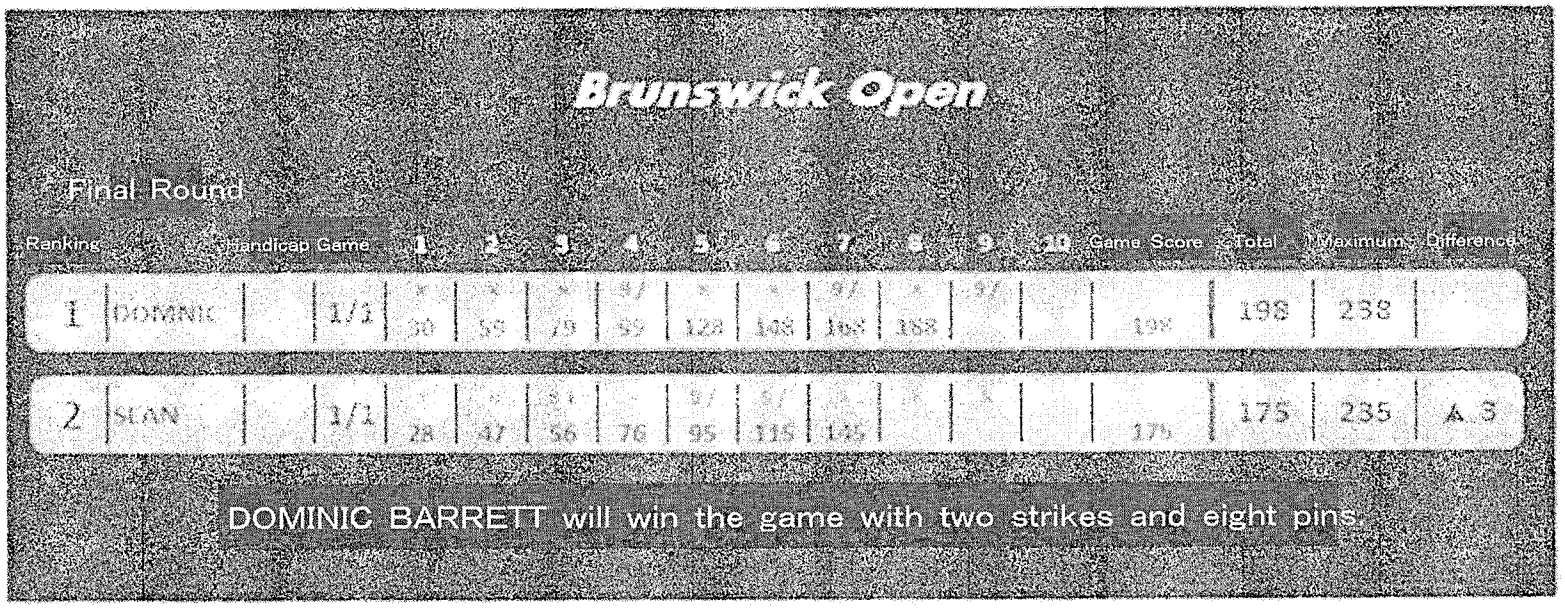
FIG. 3 is a display diagram of the lane monitor 9 and the televising lane screen 11 illustrating a specific display example in a final round of the competition when using the present disclosure.

Further, as illustrated in FIG. 2, the lane monitor 9 and the televising lane screen 11 display the players in an order from a player of a top ranking from the top, and as illustrated in FIG. 3, at the time when there is a possibility of deciding the outcome, the player name and the rolls required to win are displayed in such a way that, for example "DOMINIC BARRETT will win the game with two strikes and eight pins."

According to the information transmitted from the host computer 4, as illustrated in FIGS. 7, 8, 9 and 10, the ranking monitor 10 displays the player names in an order from the upper rankings according to the rankings based on the maximum possible scores, as well as displays what number of game of total games, what number frame, the game scores, series total scores, maximum possible scores, score differences between the maximum possible scores, and in a case of a preliminary, displays the scores required to advance to the final round.

Figure 11:
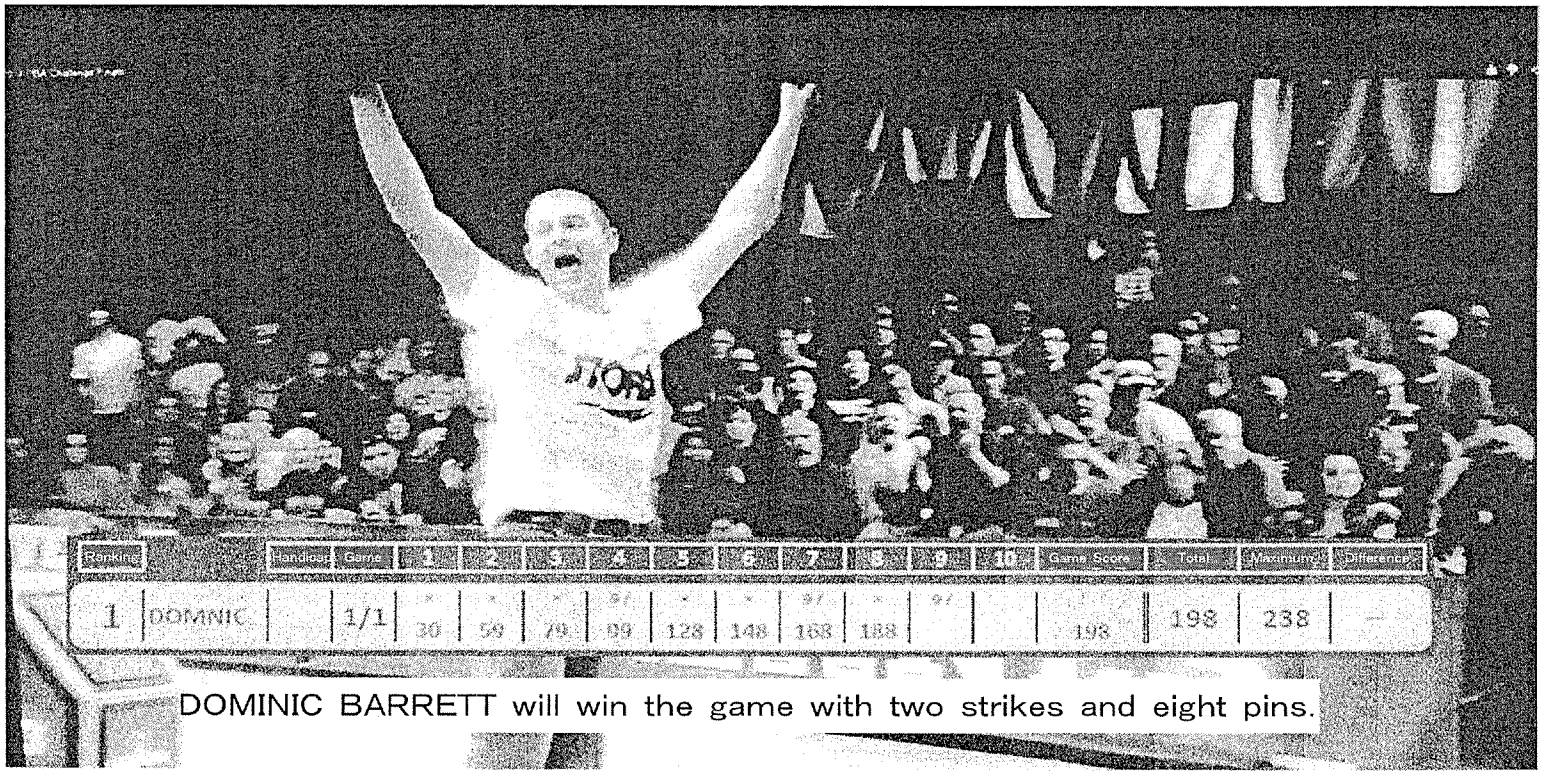
FIG. 11 is a display diagram illustrating a specific display example of a televising player TELOP 12 when using the present disclosure.

By the information transmitted from the host computer 4, as illustrated in FIG. 11, the televising player TELOP 12 displays the middle rankings for respective players, player names, handicaps, what number of game of total games, scores of each frame, game scores, series total scores, maximum possible scores, score differences between the maximum possible scores, and rolls required deciding the outcome, in such a way that, for example "DOMINIC will win the game with two strikes and eight pins," and in a case of a preliminary, displays the middle rankings of other players, player names, series total scores, maximum possible scores, and score differences between the maximum possible scores in an order from a top ranking on the lowermost portion of the screen by scrolls, which are combined into live streaming media such as a live television broadcast or the Internet such as U stream or a recorded video to be televised.

Figure 6:
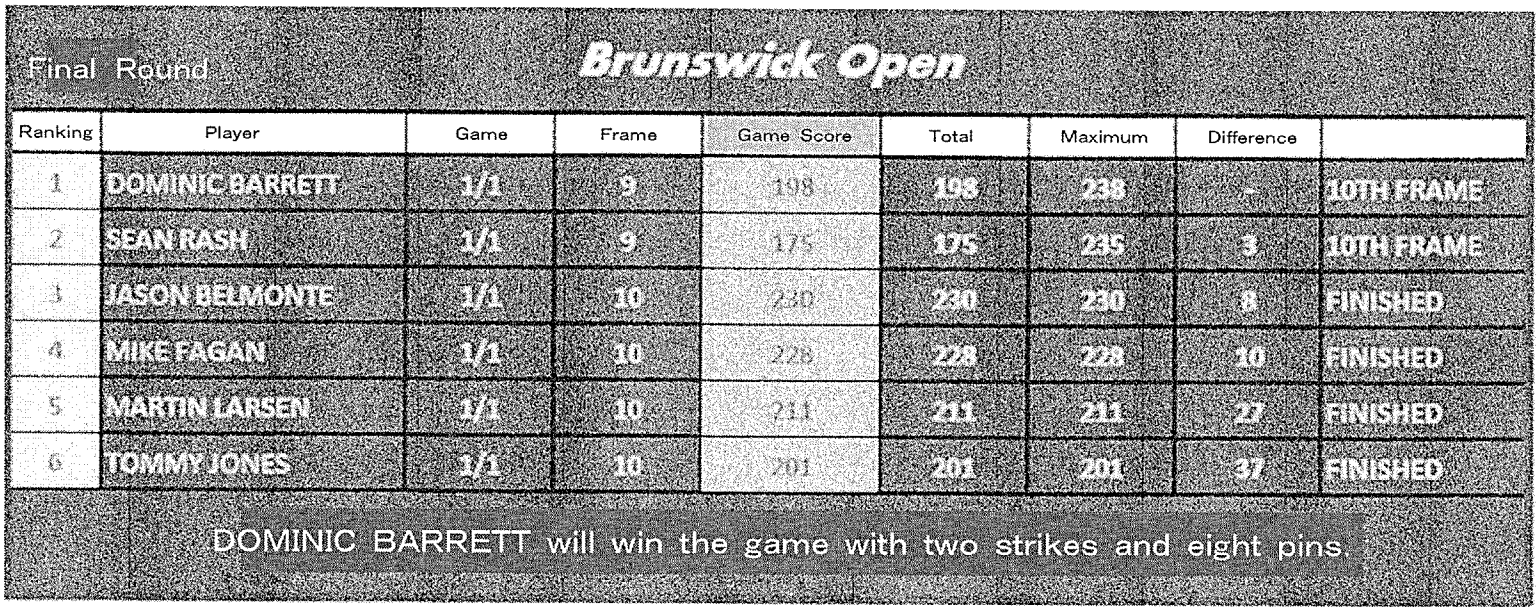
FIG. 6 is a diagram illustrating the ranking table monitor 10 and the televising ranking table screen 13 illustrating a specific display example in the final round of the competition when using the present disclosure.
Figure 7:
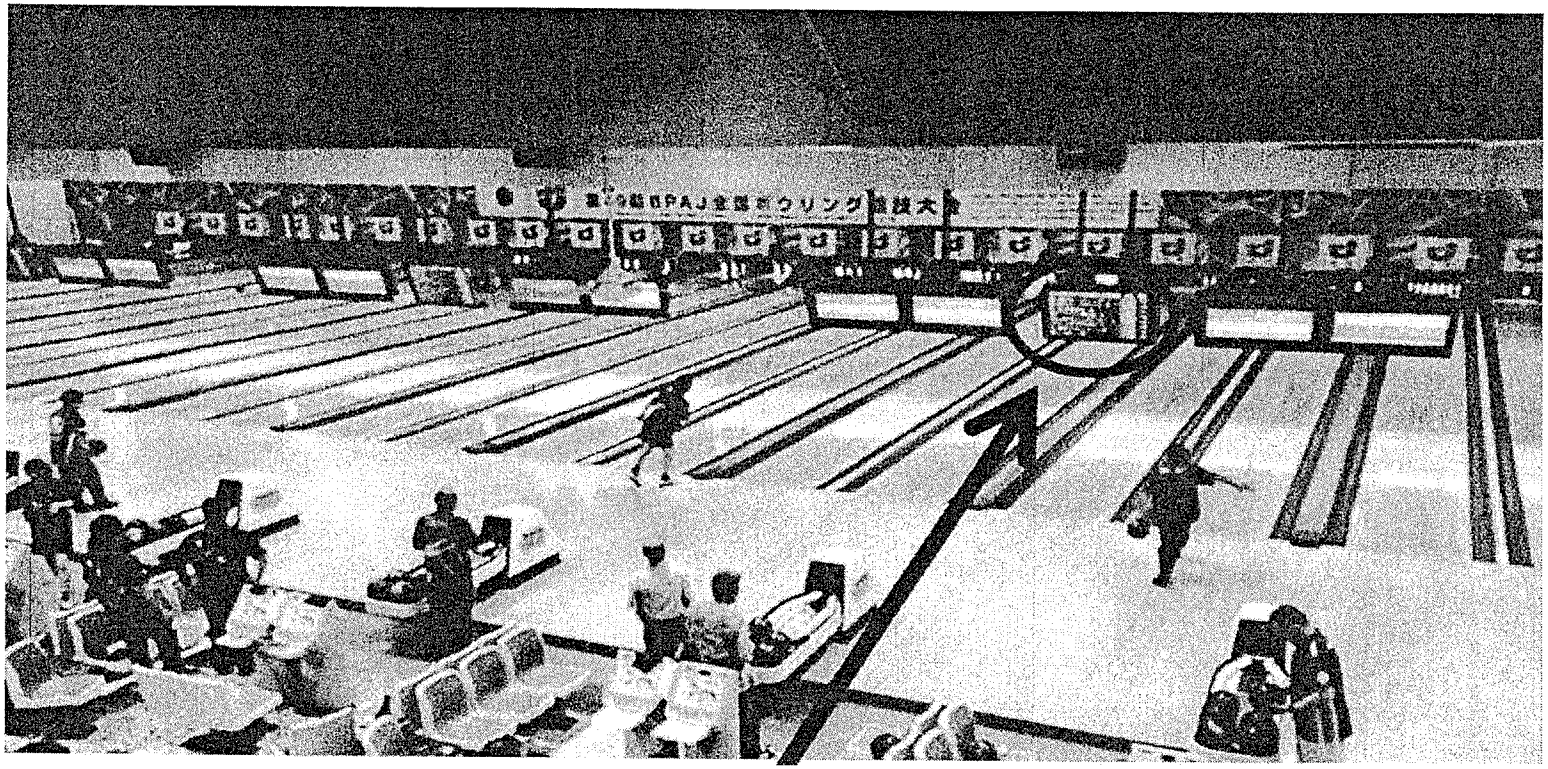
FIG. 7 is a display diagram illustrating a specific example of posting the ranking table monitor 10 when using the present disclosure.
Figure 8:
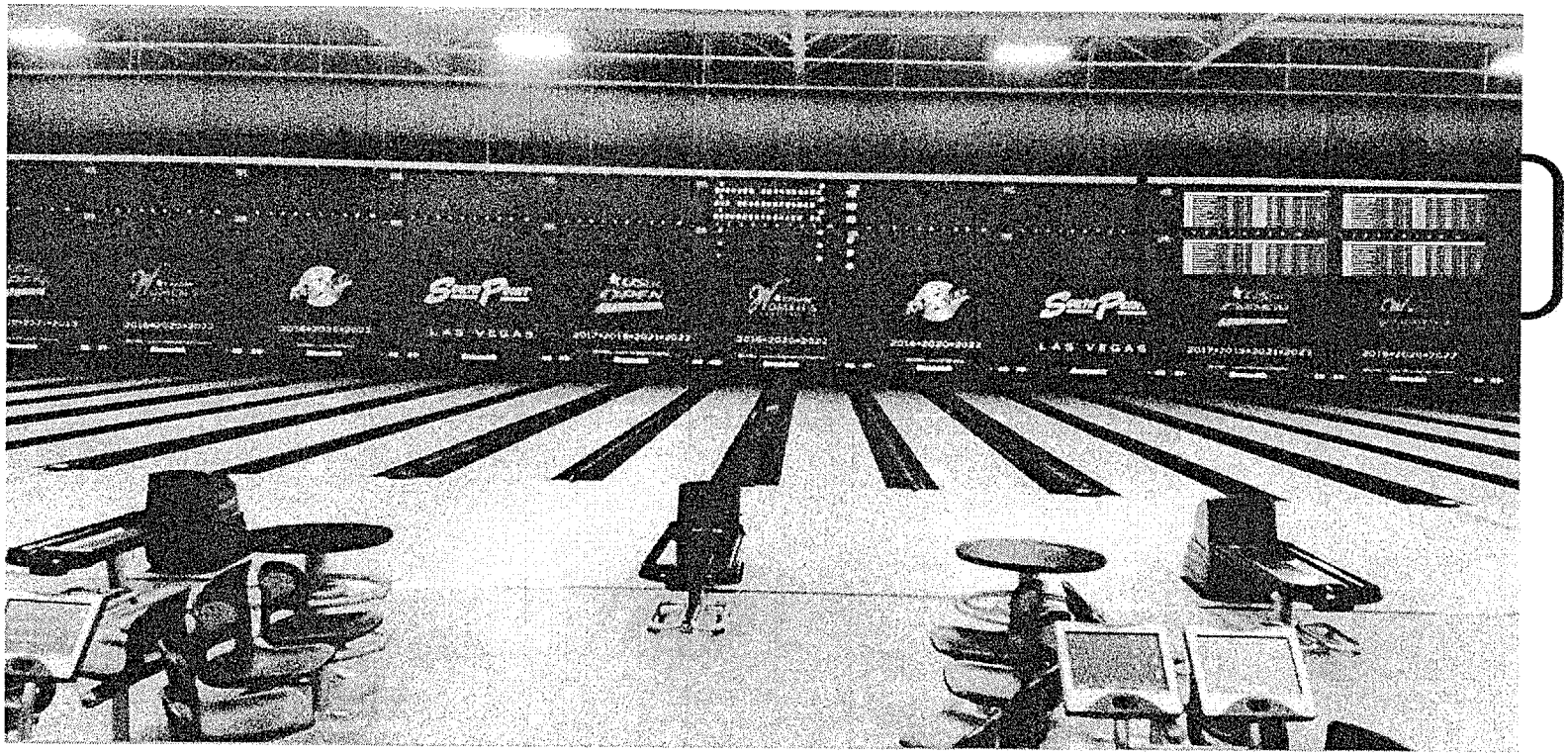
FIG. 8 is a display diagram illustrating a specific example of posting the ranking table monitor 10 when using the present disclosure.
Figure 9:
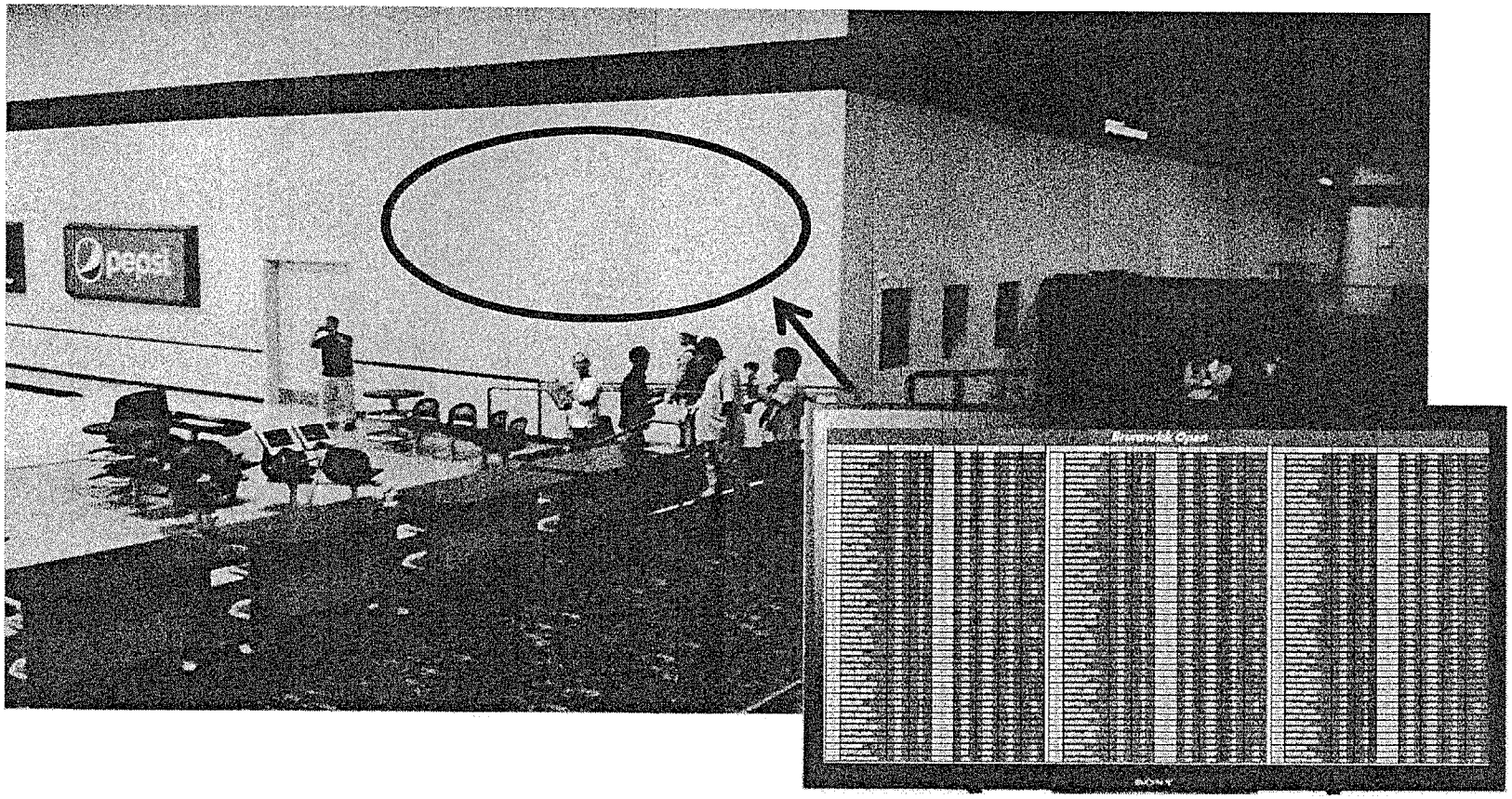
FIG. 9 is a display diagram illustrating a specific example of posting the ranking table monitor 10 when using the present disclosure.
Figure 10:
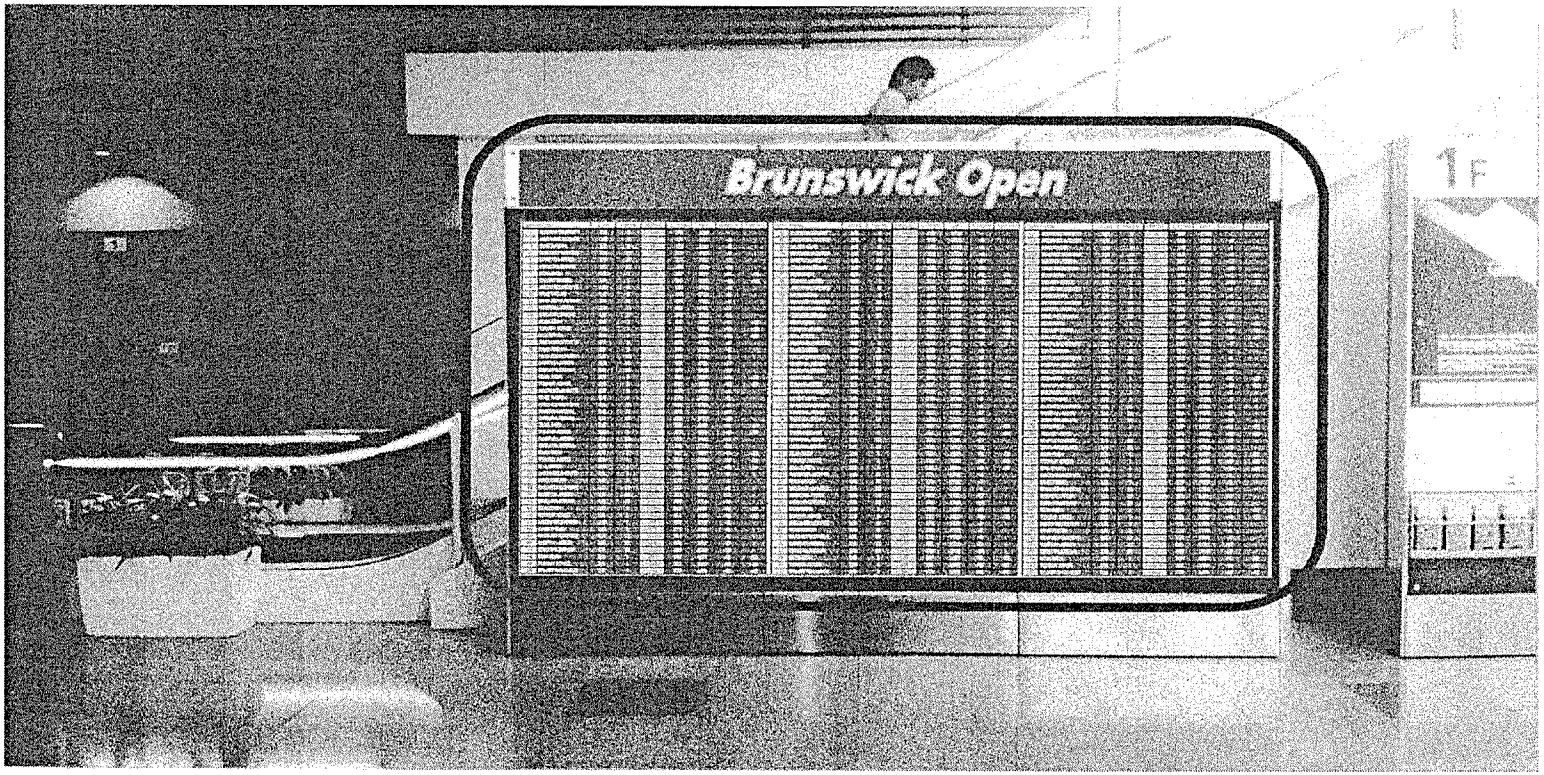
FIG. 10 is a display diagram illustrating a specific example of posting the ranking table monitor 10 when using the present disclosure.

As illustrated in FIGS. 5 and 6, similarly to the ranking table monitor 10, by the information transmitted from the host computer 4, and on the basis of the rankings based on the maximum possible scores, the televising ranking table screen 13 displays the player names in an order from the top ranking, what number of game of total games, what number frame, the game scores, series total scores, maximum possible scores, score differences between the maximum possible scores, and in a case of a preliminary, displays the scores required to advance to the final round, which are combined into a live streaming media such as a live television broadcast or the Internet such as Ustream to be televised, together with the televising lane screen 11 and the televising player TELOP 12.

DESCRIPTION OF REFERENCE NUMERALS

1 Scanner
2 Bowler console
3 Sub computer
4 Host computer
5 MCT monitor
6 MCT computer
7 Printer
8 Keyboard
9 Lane monitor
10 Ranking table monitor
11 Televising lane screen
12 Televising player TELOP
13 Televising ranking table screen

The invention claimed is:

1. A bowling auto scorer for displaying rolls deciding an outcome comprising:

a processor and a memory that stores an instruction, wherein when the processor executes the instruction, the processor performs processes of:

calculating maximum possible scores of players at any time during a game when performing a bowling game in a bowling alley by adding scores that would be attained by knocking down all pins with no missed pins in subsequent bowling rolls, comparing the calculated maximum possible scores with those of other players, and displaying middle rankings at any time during the game based on the calculated maximum possible scores for each player, and the score differences therebetween, the score differences therebetween being an integer greater than or equal to zero; and displaying final rankings and roll results required for deciding an outcome on a screen.

2. The bowling auto scorer according to claim 1, wherein the roll results include one of strikes, spares, or a number of pins knocked down.

3. A bowling auto scorer for displaying rolls deciding an outcome comprising:

a processor and a memory that stores an instruction, wherein when the processor executes the instruction, the processor performs processes of:

calculating maximum possible scores of players at any time during a game when performing a bowling game in a bowling alley by adding scores that would be attained by knocking down all pins with no missed pins in subsequent bowling rolls, and displaying the calculated maximum possible scores of each player to form a ranking list together with maximum possible score differences between the players and displaying rankings on the ranking list in the middle of the game, the score differences between the players being integers greater than or equal to zero; and displaying final rankings on the ranking list and roll results required for deciding an outcome on a screen.

4. The bowling auto scorer according to claim 3, wherein the roll results include one of strikes, spares, or a number of pins knocked down.

5. A bowling auto scorer for displaying rolls deciding an outcome comprising:

a processor and a memory that stores an instruction, wherein when the processor executes the instruction, the processor performs processes of:

calculating maximum possible scores for each player at any time during a game when performing a bowling game in a bowling alley having a plurality of bowling lanes by adding scores that would be attained by knocking down all pins with no missed pins in subsequent bowling rolls, and displaying players of a top ranking for each said lane together with rankings in order from a top based on the calculated maximum possible scores; and alternately moving displays of ranked bowlers on monitor screens above the lanes of the bowlers at every roll, when competing in an American method of using two lanes and alternately rolling at left and right lanes in odd frames and even frames.

6. The bowling auto scorer for displaying rolls deciding an outcome according to claim 5, wherein when the processor executes the instruction, the processor performs a process of:

performing a display of middle rankings based on maximum possible scores, and final rankings or roll results required for deciding an outcome on screens for respective players during a game when performing a bowling game in a bowling alley.

7. The bowling auto scorer according to claim 6, wherein the roll results include one of strikes, spares, or a number of pins knocked down.

8. The bowling auto scorer according to claim 6, wherein the performing the display comprises superimposing the middle rankings on the screens.

* * * * *